United States Patent [19]

Feldmann

[11] 4,117,883

[45] Oct. 3, 1978

[54] HEAT RETRIEVER

[76] Inventor: William F. Feldmann, R.R. #1, O'Fallon, Ill. 62269

[21] Appl. No.: 718,909

[22] Filed: Aug. 30, 1976

[51] Int. Cl.[2] ..... F28F 9/02; F24B 7/00

[52] U.S. Cl. ..... 165/174; 165/DIG. 2; 237/55

[58] Field of Search ..... 237/55; 165/DIG. 2, 165/102, 154, 155, 103, 176, 174; 126/102

[56] References Cited

U.S. PATENT DOCUMENTS

| | | | |
|---|---|---|---|
| 53,029 | 3/1866 | Morse | 165/DIG. 2 |
| 57,778 | 9/1866 | Sonniksen | 165/103 |
| 382,616 | 5/1888 | Markle | 165/103 |
| 398,115 | 2/1889 | Barnes | 165/103 |
| 897,661 | 9/1908 | Richman | 165/102 |
| 1,214,047 | 1/1917 | McGinnis | 165/DIG. 2 |
| 1,941,496 | 1/1934 | Schlech | 165/102 |
| 1,991,631 | 2/1935 | Sangster | 165/174 |
| 2,082,403 | 1/1937 | Larkin | 165/174 |
| 2,343,542 | 3/1944 | Faunce | 165/DIG. 2 |
| 2,439,109 | 4/1948 | Stout | 165/174 X |
| 2,772,076 | 11/1956 | Matthews | 165/174 |
| 2,811,217 | 10/1957 | Steitz | 165/174 |
| 3,124,197 | 3/1964 | Funk | 165/154 |

FOREIGN PATENT DOCUMENTS

| | | | |
|---|---|---|---|
| 22,048 | 3/1917 | Denmark | 165/103 |
| 381,273 | 9/1923 | Fed. Rep. of Germany | 165/154 |

*Primary Examiner*—Charles J. Myhre
*Assistant Examiner*—Sheldon Richter
*Attorney, Agent, or Firm*—Clarence A. O'Brien; Harvey B. Jacobson

[57] ABSTRACT

A heat retriever having a shell provided with an inlet and an outlet for permitting a fluid to be circulated through the shell and heated by a retriever assembly including a vent pipe attachable to a flue pipe of a furnace. At least one, and preferably a plurality of retriever pipes are connected in parallel to the vent pipe within the shell for forming a bypass around a portion of the vent pipe of exhaust gas from the associated furnace flue pipe and exposing the fluid to be heated to a larger heat transfer surface. A blower is advantageously mounted on the inlet of the shell in order to provide a flow of forced air over the retriever pipes.

4 Claims, 4 Drawing Figures

HEAT RETRIEVER

BACKGROUND OF THE INVENTION

1. Field of the Invention

This invention relates generally to a heat retriever, and particularly to a heat retriever mountable on the flue pipe of a furnace in order to heat a fluid medium, such as air, by the combustion gases from the furnace.

2. Description of the Prior Art

It is generally known to provide a heat transfer device generally referred to as a heat economizer, a heat conserver, or a heat retriever on the flue pipe of a furnace in order to recover some of the waste energy represented by combustion gases passing through the flue pipe. Examples of such prior art devices can be found in U.S. Pat. Nos. 525,896, issued Sept. 11, 1894 to H. I. Grennell; 983,680, issued Feb. 7, 1911 to W. H. Butcher; 1,487,709, issued Mar. 25, 1924 to H. Besser; 1,953,302, issued Apr. 3, 1934 to W. D. Johnston; and 1,960,510, issued May 29, 1934 to C. E. Ridgeway.

SUMMARY OF THE INVENTION

It is an object of the present invention to provide a heat retriever of simpler, more compact, and more efficient construction than found among prior art devices for the purpose of regaining heat from flue gases.

It is another object of the present invention to provide a heat retriever which presents a maximum amount of heat transfer surface to the air being heated by the retriever.

These and other objects are achieved according to the present invention by providing a heat retriever having: a shell provided with an inlet and an outlet for permitting a fluid to be heated to pass through the shell; and vent pipe attachable to a flue pipe of a furnace and arranged extending through the shell; and a retriever pipe connected in parallel to the vent pipe within the shell for forming a bypass around a portion of the vent pipe of exhaust gas from the associated furnace flue pipe and exposing the fluid to be heated to a larger heat transfer surface.

The vent pipe advantageously includes a restrictor arrangement for diverting flue gas from the vent pipe to the retriever pipes. This restrictor arrangement preferably includes a deflector fin mounted within the vent pipe at an entrance to the retriever pipe disposed upstream of a flow of flue gas through the vent pipe. This fin is downstream of the entrance to the retriever pipe and extends into the vent pipe for partially blocking the passage of flue gases and diverting flue gas into the retriever pipe.

In addition to the aforementioned deflector fin, or as the sole element of the restrictor arrangement when certain types of furnaces, such as an oil furnace, are employed wherein the ash generated by burning of the fuel would dictate against the use of a deflector fin, a hollow, frustum of a cone can be disposed in the vent pipe downstream of the flow of flue gas through the vent pipe from the entrance to the retriever pipe for providing a resistance to the flow of flue gas and causing flue gas to flow into the lesser resistance afforded by the retriever pipe.

Preferably, there are a plurality of retriever pipes mounted on the vent pipe, with each of the retriever pipes connected in parallel to the vent pipe and disposed entirely within the shell. If deflector fins are used in conjunction with the plurality of retriever pipes for the purpose of diverting flue gas through the retriever pipes, each of the retriever pipes would be provided with such a deflector fin disposed at the entrance to the retriever pipe.

A blower, and the like, is advantageously mounted over the inlet of the shell for creating a forced fluid flow through the shell.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
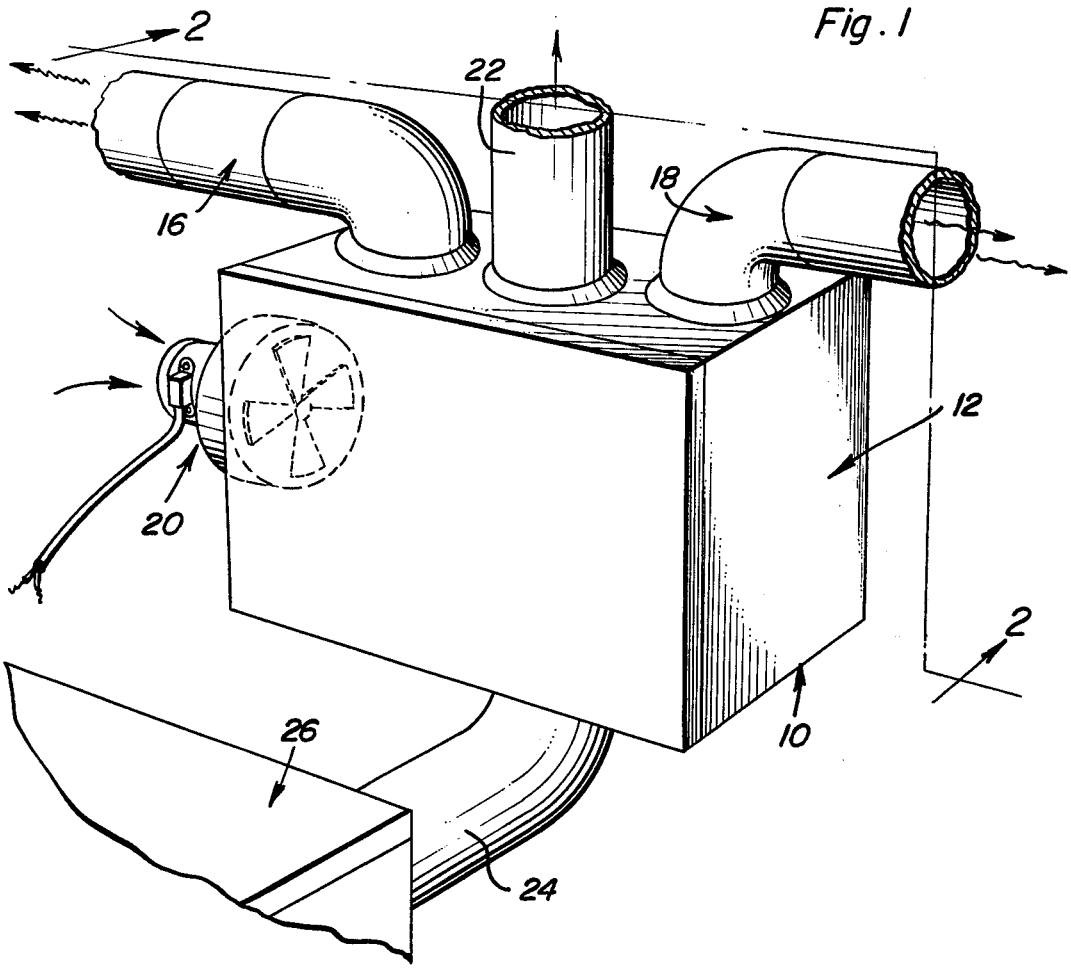
FIG. 1 is a fragmentary, perspective view showing a heat retriever according to the invention mounted on a furnace.
Figure 4:
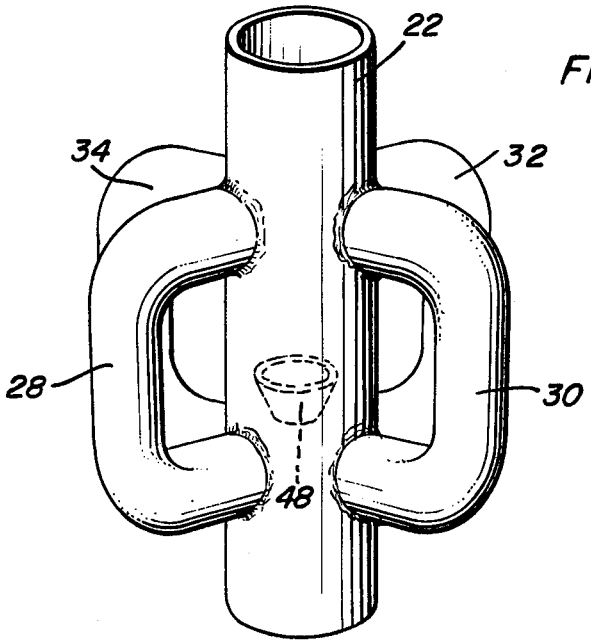
FIG. 4 is a perspective view showing a heat transfer assembly used with a heat retriever according to the invention.

Referring now more particularly to the figures of the drawings, a heat retriever 10 according to the invention includes a shell 12 of substantially rectangular, hollow construction and provided with an inlet 14 which preferably includes the illustrated filtering screen, and a pair of outlet pipes 16 and 18. A blower 20 is arranged over the inlet 14 for creating a forced flow of the air or other medium to be heated into inlet 14, through shell 12, and out the outlet pipes 16 and 18. Although a pair of outlet pipes 16 and 18, each connected to appropriate openings provided in shell 12, has been illustrated and has certain advantages in distributing air about a conventional residence, and the like, it will be appreciated that only a single outlet is necessary to carry out the invention.

A vent pipe 22 is attached to a flue pipe 24 of a conventional furance 26. This vent pipe 22 is arranged extending completely through shell 12, and is provided with four retriever pipes 28, 30, 32, and 34 connected in parallel to the vent pipe 22 entirely within shell 12 for forming bypasses around a portion of vent pipe 22 for flue or combustion gases from furnace 26 and flue pipe 24 and exposing the air to be heated to a larger heat transfer surface than would be realized by the use of flue pipe 24 alone. Although the number of retriever pipes employed with a vent pipe 22 to form a heat transfer assembly can vary, it has been found that the illustrated four retriever pipes 28, 30, 32, and 34 affords maximum efficiency of the heat retriever unit when employed with a standard size furnace. On larger furnaces, however, six retriever pipes, for example, could be used to obtain maximum efficiency. The number of heat retriever pipes employed not only depends on the furnace size, but also on the size of the flue pipe 24. The latter will affect the diameter of the vent pipe 22, and the larger the diameter of the vent pipe 22 the more retriever pipes can be efficiently mounted around the circumference of the vent pipe 22.

Disposed extending into the vent pipe 22 are deflector fins 36, 38, 40, and 42 which are preferably extensions of the respective retriever pipes 28, 30, 32, and 34 so as to be disposed at associated entrances of the retriever pipes upstream of a flow of flue gas through the vent pipe 22. By this arrangement, the deflector fins 36, 38, 40, and 42 are located downstream of the entrance to the respective retriever pipes and extend into the vent pipe 22 in such a manner as to direct flue gas into the retriever pipes 28, 30, 32, and 34.

Figure 2:
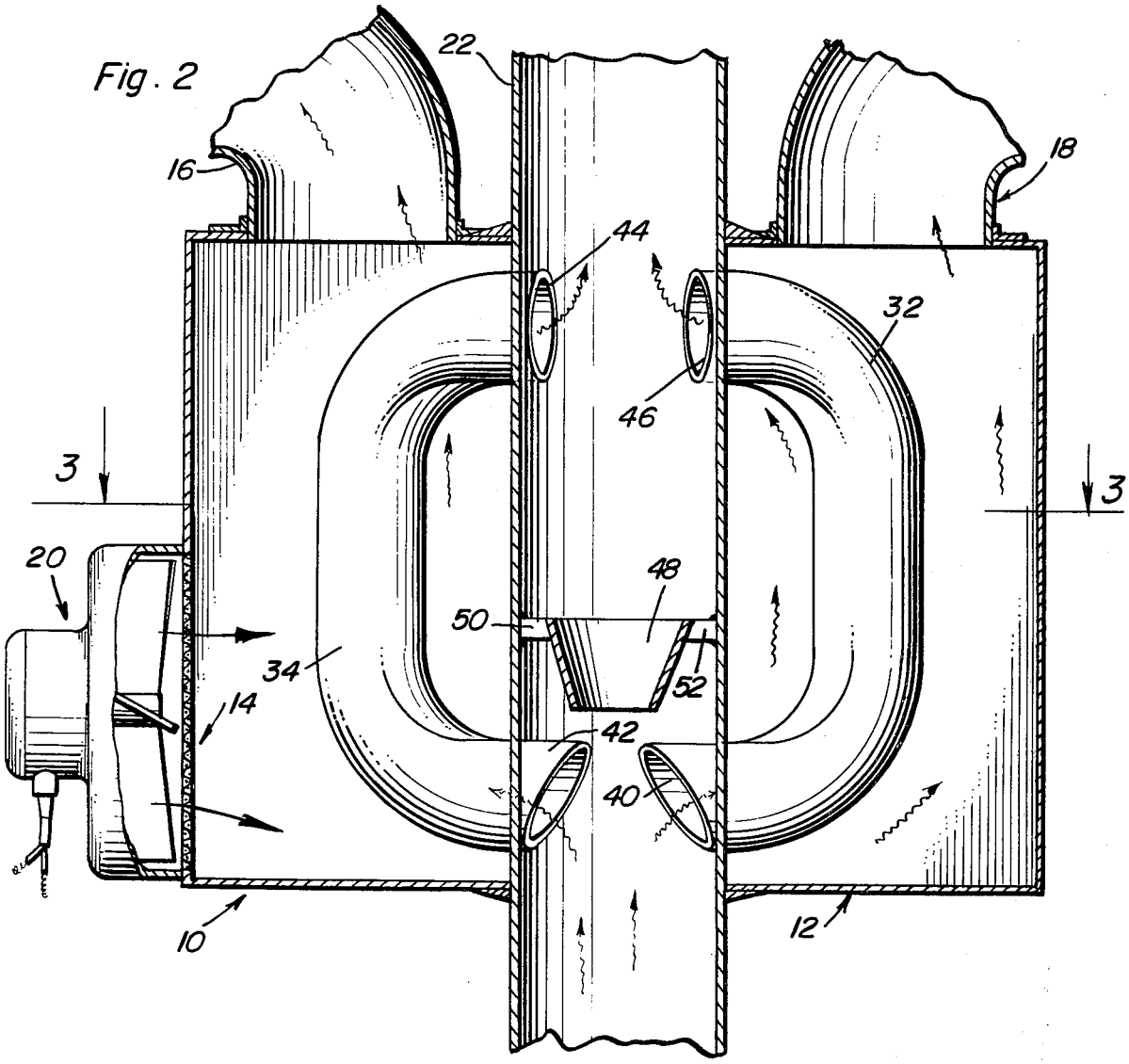
FIG. 2 is an enlarged, fragmentary, sectional view taken generally along the line 2—2 of FIG. 1.
Figure 3:
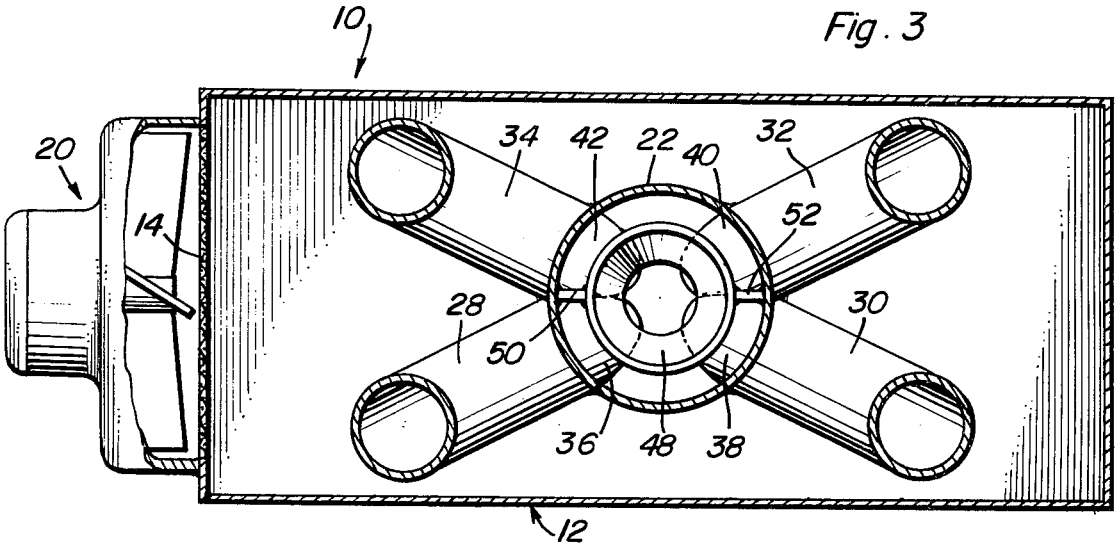
FIG. 3 is a fragmentary, sectional view taken generally along the line 3—3 of FIG. 2.

The retriever pipes 28, 30, 32, and 34 are connected to vent pipe 22 also at the downstream end of the flow of flue gas so as to form exits, of which exits 44 and 46 can be seen in FIG. 2. Thus, the entire flow of the combustion gases into the vent pipe 22 as at the bottom of FIG. 2 will be re-united within the vent pipe 22 at the upper portion thereof as seen in FIG. 2 after a predetermined amount of the gas has been diverted through the retriever pipes 28, 30, 32, and 34.

While the deflector fins 36, 38, 40, and 42 can be used exclusively to form a restrictor arrangement for diverting the flue gas from the vent pipe 22 to the retriever pipes, it is also possible to use either in addition to or alternative with the deflector fins a hollow, frustum of a cone 48 disposed in vent pipe 22 downstream of the flow of combustion gases through vent pipe 22 and also downstream from the entrances to the retriever pipes 28, 30, 32, and 34 at which the respective deflector fins 36, 38, 40, and 42 are disposed. This cone 48, which is suitably mounted within vent pipe 22 as by the illustrated supports 50 and 52, provides a resistance to the flow of gas through vent pipe 22 and causes the gas to flow into the retriever pipes 28, 30, 32, and 34 as paths of lower resistance. Cone 48 may be used exclusively in those situations where the particular fuel, such as fuel oil, creates an ash which dictates against the use of the deflector fins.

It can be readily understood from the above description and from the drawings that a heat retriever 10 according to the invention provides a very efficient, compact, and inexpensive manner of recovering waste heat from a furnace, and the like. For example, when used with a 125,000 BTU natural gas furnace a heat retriever 10 vertically oriented and connected to a flue pipe six inches in diameter and provided with a six inch fan with a separate thermostat control in order to gain maximum efficiency takes exhaust gases from the furnace at approximately 200° F. (93.33° Celsius) will heat ambient air within the shell 12 of heat retriever 10 to approximately 112° F. (44.44° Celsius).

While the unit illustrated in the drawings is provided with a blower 20 in order to create a forced flow of air through shell 12, when the retriever 10 is being employed with a furnace having a forced air distribution system associated with it, it is possible to connect the inlet 14 of retriever 10 directly to the bonnet (not shown) of the furnace and eliminate the blower 20. When the inlet 14 of shell 12 is connected to a furnace bonnet, however, it is also necessary to provide a butterfly valve (not shown) in a conventional manner in order to block off inlet 14 during cooling periods of the associated residence or other structure (not shown) if a cooling unit is also connected to the air distribution duct work (not shown) for distributing cool air throughout the structure.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A heat retriever, comprising, in combination:

(a) a shell provided with an inlet and an outlet for permitting a fluid to be heated to be passed through the shell;

(b) a vent pipe attachable to a flue pipe of a furnace and arranged extending through the shell; and (c) a plurality of retriever pipes each connected to and arranged in parallel with the vent pipe and disposed entirely within the shell for forming a bypass around a portion of the vent pipe for combustion gases received from the associated furnace flue pipe and exposing the fluid to be heated to a larger heat transfer surface, and the vent pipe including restrictor means for diverting the combustion gases from the vent pipe to the retriever pipes, the restrictor means including opposed deflector fins terminating the retriever pipes at an entrance of the retriever pipes and being extensions thereof into the vent pipe and disposed upstream of a flow of combustion gases through the vent pipe, the fins being downstream of the entrance to the retrieve pipes and extending into the vent pipe for diverting combustion gases into the retriever pipes, the retrictor means further including a hollow, frustum of a cone disposed within the vent pipe downstream from the entrance to the retriever pipes for providing a resistance to the flow of combustion gases and causing the combustion gases to flow into the retriever pipes as a path of less resistance.

2. A structure as defined in claim 1, wherein the shell includes a blower mounted over the inlet of the shell for creating a forced fluid flow through the shell.

3. A structure as defined in claim 1, wherein there are at least four retriever pipes.

4. A structure as defined in claim 3, wherein the shell includes a blower mounted over the inlet of the shell for creating a forced fluid flow through the shell.

* * * * *